US006065570A

United States Patent [19]

Friedli et al.

[11] Patent Number: 6,065,570

[45] Date of Patent: May 23, 2000

[54] CONTROL SYSTEM FOR A PLURALITY OF GROUPS OF LIFTS WITH DESTINATION CALL CONTROL SYSTEM

[75] Inventors: Paul Friedli, Remetschwil; Miroslav Kostka, Ballwil; Kurt Steinmann, Rotkreuz, all of Switzerland

[73] Assignee: Inventio AG, Hergiswil, Switzerland

[21] Appl. No.: 09/155,747

[22] PCT Filed: Feb. 18, 1997

[86] PCT No.: PCT/CH97/00055

§ 371 Date: Oct. 5, 1998

§ 102(e) Date: Oct. 5, 1998

[87] PCT Pub. No.: WO97/37922

PCT Pub. Date: Oct. 16, 1997

[30] Foreign Application Priority Data

Apr. 3, 1996 [CH] Switzerland ..... 866/96
Nov. 1, 1996 [EP] European Pat. Off. ..... 96810728

[51] Int. Cl.[7] ..... B66B 1/18

[52] U.S. Cl. ..... 187/387

[58] Field of Search ..... 127/247, 380, 127/382, 385, 386, 388, 389, 371, 373, 396

[56] References Cited

U.S. PATENT DOCUMENTS 4,355,705 10/1982 Schroeder et al. ..... 187/29 R
5,239,142 8/1993 Ekholm et al. ..... 187/127
5,300,738 4/1994 Kostka et al. .
5,300,739 4/1994 Bittar ..... 187/127
5,306,878 4/1994 Kubo .
5,317,114 5/1994 Pullea et al. ..... 187/128
5,382,761 1/1995 Amano .
5,831,226 11/1998 Hattori et al. ..... 187/382

FOREIGN PATENT DOCUMENTS 356 731 3/1990 European Pat. Off. .
403 232 12/1990 European Pat. Off. .
523 601 1/1993 European Pat. Off. .
2 290 885 1/1996 United Kingdom .

*Primary Examiner*—Jonathan Salata
*Attorney, Agent, or Firm*—Cohen, Pontani, Lieberman & Pavane

[57] ABSTRACT

The invention concerns a control system for a plurality of groups of lifts (G1–G5), according to which system the passenger can input his destination at any destination call input device (TE) without having to know which group of lifts (G1–G5) serves the desired storey. In this way, in large buildings in which, for structural reasons, the ranges of storeys served by individual groups of lifts (G1–G5) are disposed adjacent one another in a confused manner, the passenger's search for the appropriate lift is facilitated. The multiple groups control system always selects the most favorable lift from all the available lifts and, when the storey ranges served by a plurality of groups of lifts (G4–G5) overlap, the selection is made from all the possible lifts. If the passenger has to change lifts, the connecting lift is shown on a display.

15 Claims, 6 Drawing Sheets

CONTROL SYSTEM FOR A PLURALITY OF GROUPS OF LIFTS WITH DESTINATION CALL CONTROL SYSTEM

BACKGROUND OF THE INVENTION

1. Field of the Invention

The invention relates to a control for several elevator groups with destination call control and immediate allocation, in which all destination call controls are combined into a common multigroup control.

2. Discussion of the Prior Art

The previous solutions of transport of persons in large buildings are based on division of the building into individual zones which mostly are each served by a respective elevator group.

With conventional two-button controls as well as with previous destination call controls, such as, for example, for the group control equipment that has become known through EP 356 731, the passenger must first find the group which serves his desired floor. Only then will the appropriate UP or DOWN floor call or, in the case of the destination call control, the destination call be entered in the case of the conventional control. Although the traffic flow of persons is simplified in the case of the destination call group control, the search for the appropriate elevator group, however, still remains.

A destination call control with a dynamic sector allocation for an elevator group has become known by US Patent No. 5,382,761. A new destination call is in that case allocated either to an elevator car, the sector to be served by which includes the destination floor, or the new destination call is allocated to a car which is not yet associated with an existing sector or the sector of which lies near to the destination floor and is enlarged to this. The control in that case takes into consideration the size of the already fixed sectors and allocates the new destination call to the smallest sector. A respective display, which indicates the served sector, is arranged above each elevator.

In the case of the afore-described destination call control with dynamic sector allocation, the passenger can enter his desired destination floor and must then, by reference to the displays, find the elevator which serves his floor. If several elevators are present, the search for the correct elevator proves to be arduous, especially when many persons are at a main stop at a peak traffic time. In addition, the search for the correct elevator becomes more difficult when the individual elevator groups are not arranged in ascending or descending sequence adjacent to one another.

SUMMARY OF THE INVENTION

The invention is based on the object of providing a control for elevators with destination call control of the initially mentioned kind, wherein the destination call entry can be undertaken at any desired call-registering equipment which is not allocated to a specific elevator group, and an allocated elevator is unambiguous and simple to recognize for the passenger.

Pursuant to this object, and others which will become apparent hereafter, one aspect of the present invention resides in a control for several elevator groups with destination call control and immediate allocation. The control includes means for inputting a call for an elevator car, means for displaying an allocated car in response to the input means, and a common multigroup control into which the destination call controls of the elevator groups are combined for selecting a most favorable elevator from all elevators of all groups.

The advantages achieved by the invention are to be seen essentially in that the passenger does not need to know the building division into individual zones (floor regions) which are served only by individual elevator groups. Equally, he does not need to know those floor regions which are served by elevators of several groups. When the zones served by several elevator groups overlap, the selection from all elevators coming into question is made automatically.

In another embodiment of the invention the controls of the individual elevators of a group are connected into a group control and the group controls are then connected with a central multigroup control.

In still another embodiment the controls of the individual elevators of a group are connected into a group control wherein one of the group controls also takes over the function of the multigroup control. The passengers know, before the car has reached a floor at which another elevator has to be transferred to, which elevator of another elevator group is associated with their destination call and in which direction the elevator is to be found after leaving the car. Since the destination calls on the transfer floor need not be entered once again, time is gained and crowding of the passengers and the mutual obstruction connected therewith is avoided.

BRIEF DESCRIPTION OF THE DRAWINGS

Embodiments of the invention are illustrated in the drawing and explained more closely in the following. There.

DETAILED DESCRIPTION OF THE PREFERRED EMBODIMENTS

Figure 1:
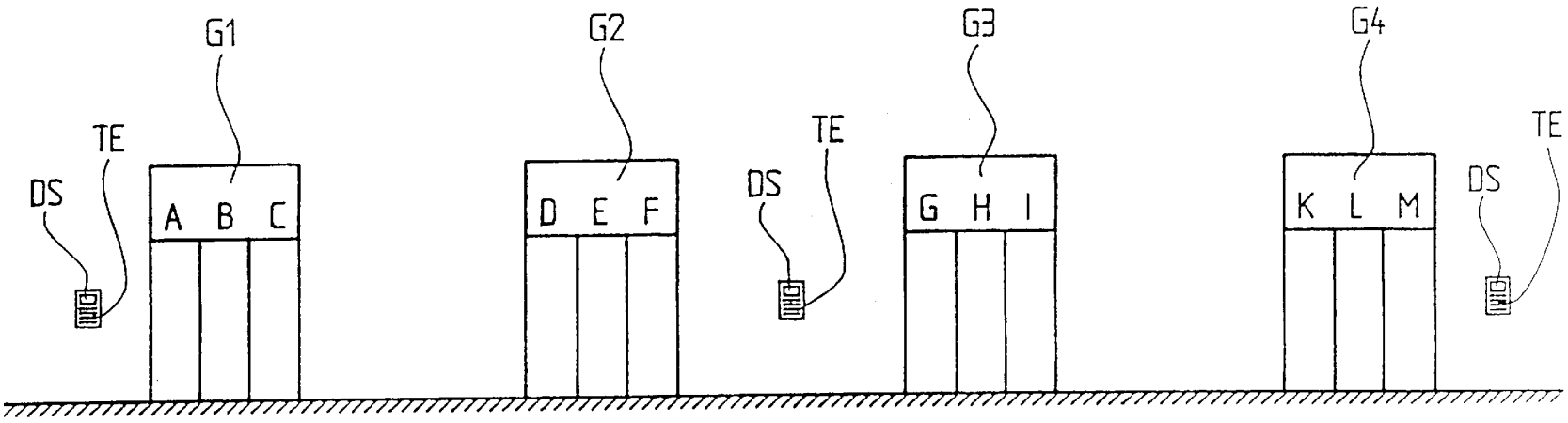
FIG. 1 shows a schematic illustration of a main stop of an elevator installation which serves different sectors.

FIG. 1 shows a schematic illustration of an elevator installation with four elevator groups which serve different sectors. An elevator group consists of one or more elevators. In a building, the sectors can, for example, be allocated to the elevator groups as follows: One elevator group G1 serves the floors 1 to 6, elevator group G2 serves the floors 1 and 7 to 9, elevator group G3 serves the floors 1 and 10 to 13 and elevator group G4 serves the floors 1 and 14 to 20. An arriving passenger does now not need to know the sectors allocated to the groups G1, G2, G3 and G4 and also does not need to enter his desired travel destination directly at the group G1, G2, G3 and G4 serving his destination floor. He can tap in every travel destination by any desired destination call input device TE which is arranged in the proximity of the groups G1, G2, G3 and G4. Subsequently, the selected elevator A, B, C to Z is immediately made known to the passenger visually by way of a display device DS or acoustically. The identification of the elevators A, B, C to Z advantageously takes place by Latin letters or numbers which are arranged in ascending or descending sequence. In that case, all elevators A, B, C to Z can be denoted by the alphabetically arranged letters or numbers independently of the floor regions served. The identification of the elevators is to be so arranged that the allocated elevator can be recognized unambiguously from each destination call input device TE.

This solution is very simple to operate and makes it easier for the passenger to find his elevator A, B, C to Z. The passenger flow is disentangled in good time and is accelerated. Thereby, the space at the main stop, especially during peak traffic times, can be better utilised.

Figure 2:
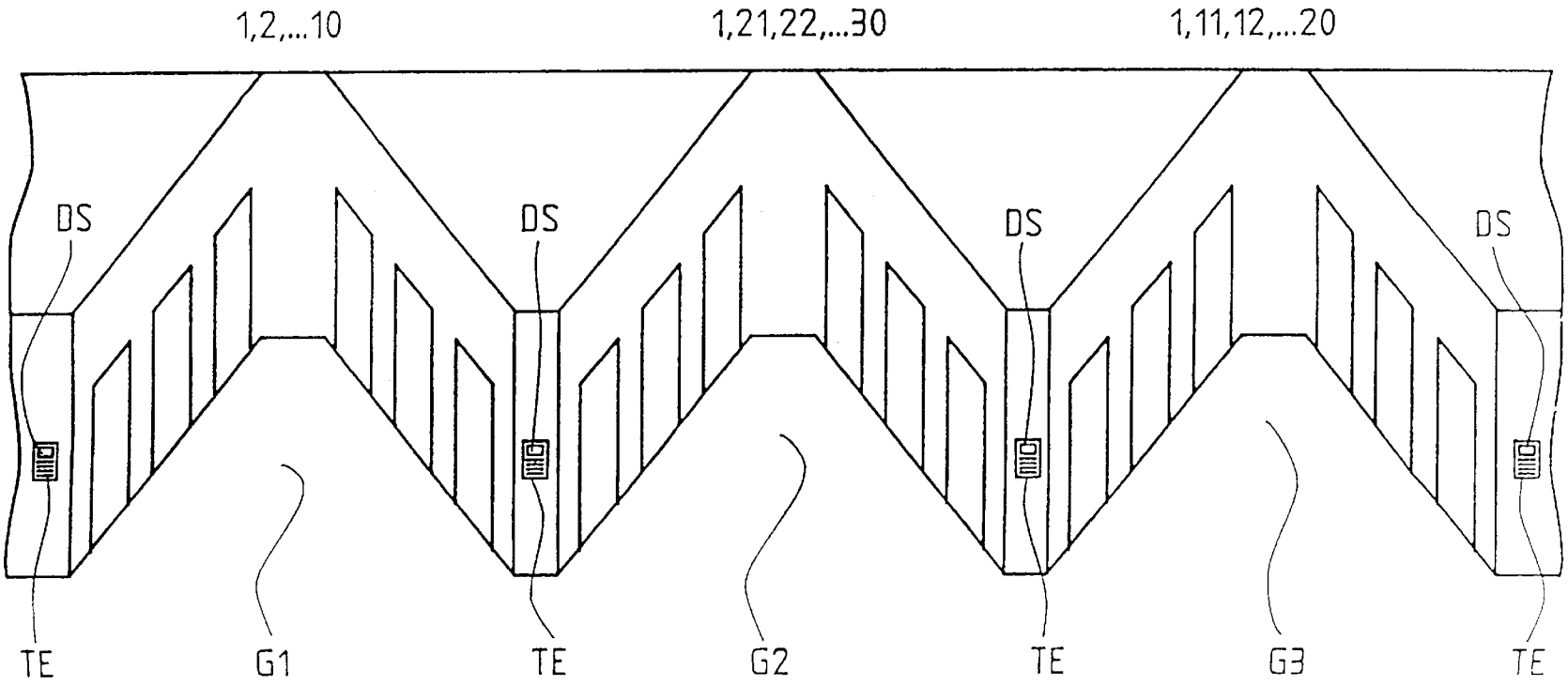
FIG. 2 shows a schematic illustration of a main stop of an elevator installation with three elevator groups.

FIG. 2 shows a schematic illustration of a main stop of an elevator installation with three elevator groups which serve respectively different sectors. For example, the elevators of the first group G1 serve the floors 1 to 10, the elevators of the second group G2 serve the floors 1 and 21 to 30 and the elevators of the third group G3 serve the floors 1 and 11 to 20.

Frequently, the floor regions served by individual elevator groups G1, G2 and G3 in large buildings are for constructional reasons not even arranged beside one another in ascending or descending sequence. Particularly in such buildings the search for his elevator is made easier for the passenger. In this case, too, it is sufficient to enter the destination floor at any desired destination call input device TE. The multigroup control always selects the most favourable elevator from all available elevators and, when the floor regions served by several elevator groups G1, G2 and G3 overlap, the selection is made from all elevators coming into question. As in the description concerning FIG. 1, the most favourable car is immediately allocated to the destination call of the passenger and made known to the passenger visually on the display device OS or acoustically. In this group arrangement, too, each elevator car is provided with an easily visible Latin letter or number in ascending or descending sequence.

Figure 3:
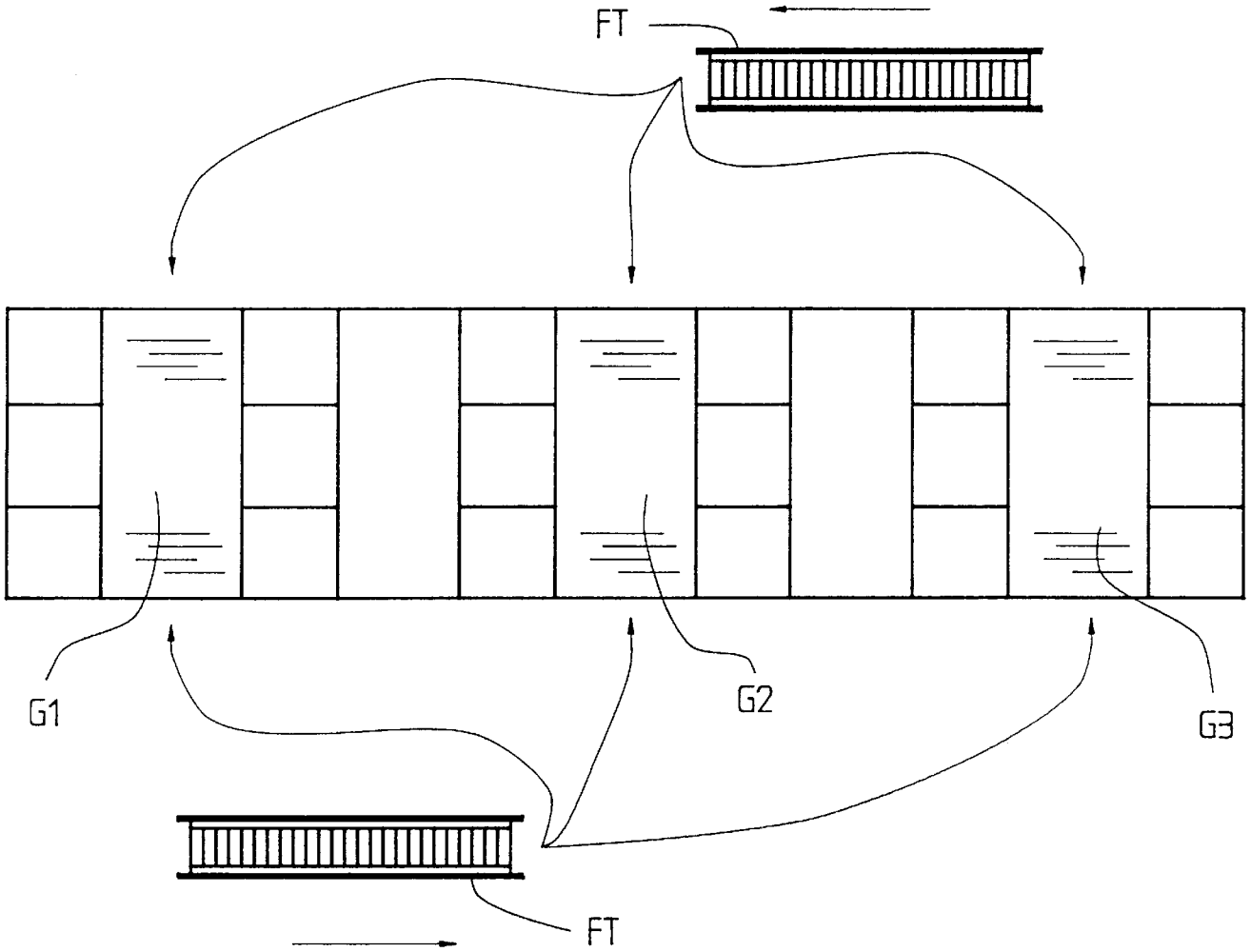
FIG. 3 shows a schematic illustration of an elevator installation with three elevator groups with two-sided passenger feed by way of escalators.

FIG. 3 shows an arrangement of elevator groups, wherein the elevator lobbies are accessible from two sides and the passengers arrive at the main stop, for example, by way of escalators FT arranged in mirror image. According to experience, roost of the passengers, who normally use the other escalator, first choose the wrong direction to their elevator group. This problem is similarly solved by the multigroup control; the passenger can enter his travel destination early at any desired destination call input device. The display device OS in addition contains an arrow which points in the direction of the allocated lift.

Figure 4:
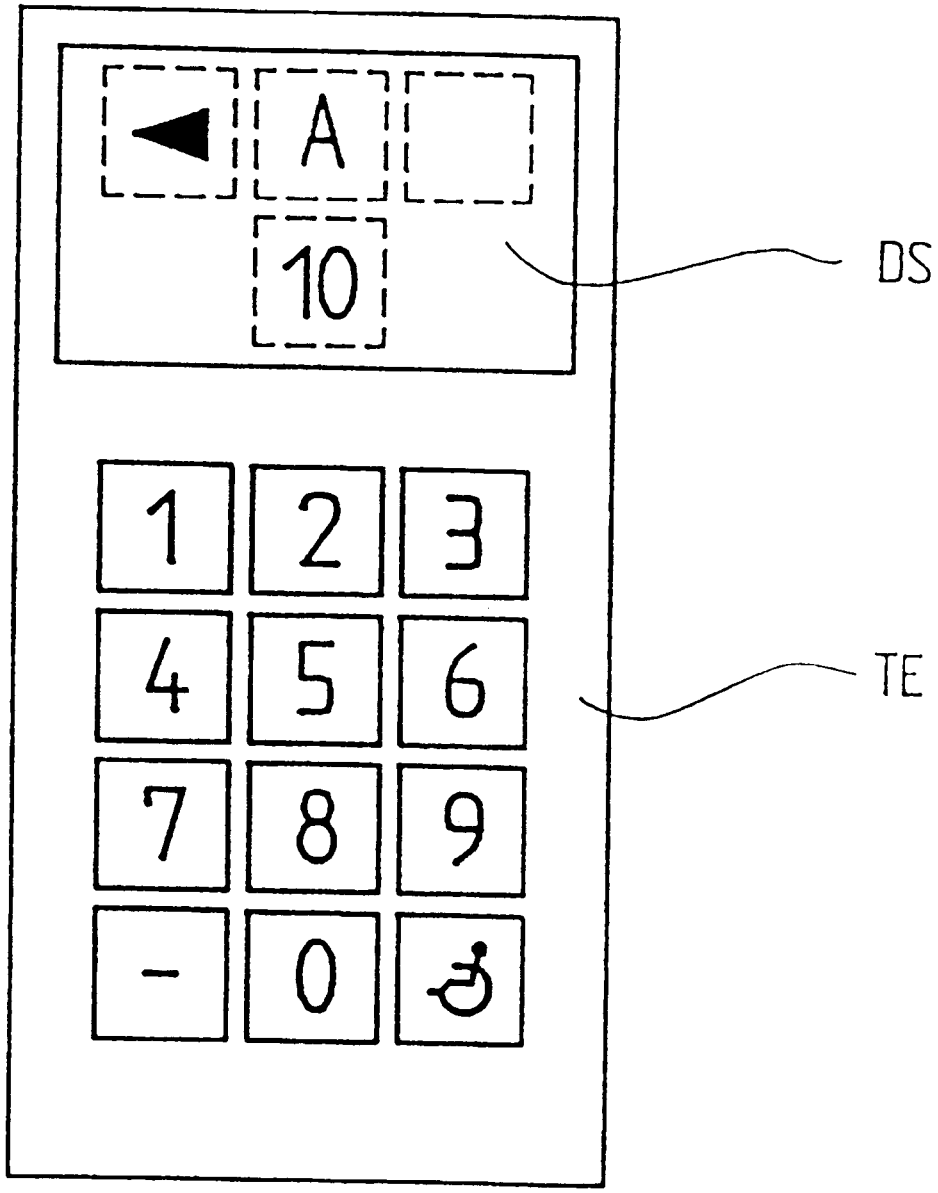
FIG. 4 shows a destination call input device for a multigroup control.

FIG. 4 shows a destination call input device TE for a multigroup control. Each destination call input device TE is provided with a keyboard, for example a decade keyboard, and the display device Os.

All destination call controls of the groups G1, G2 and G3 are connected into one central multigroup control. The individual connections can be realized by way of communications cables (bus) or wirelessly by means of a transmitter and receiver.

The possibility also exists that the individual destination call controls are connected directly by way of communications cables (bus) or wirelessly by means of a transmitter and receiver and one of the group destination call controls takes over the function of the multigroup.

The multigroup control now ascertains the most favourable elevator from all elevators A, B, C to Z coming into question, even when several sectors overlap.

The principle of the destination call control firstly makes it possible to so control several elevator groups that the passenger can enter the destination floor at any desired decade destination call input device. All elevators in a building (or building region) are thus virtually available to him. The multigroup control makes the selection of the best elevator which serves the desired floor. The passenger sees the elevator destination ("A", "B" and so forth) of the elevator allocated to him on the display device DS immediately after the acknowledgement of the entered floor number. This information can, for example, be augmented additionally in the form of an arrow, which points in the direction to the lift door, on the display device DS.

The multigroup control operates by an optimizing process for the selection of the most favorable elevator such as is described in, for example, EP 301 173 (service costs optimization). Moreover, the approach paths are individually included in the computation for each distance "destination call input device to elevator door" in the multigroup control so that this is not perceived as waiting time by the passenger.

The selection of the elevators from several groups is possible only at the main stop and on floors which are served by different groups.

As further variant, the destination call entry can also take place implicitly. In that case, an information transmitter, which consists principally of an antenna and an electronic transmitter part, sends data to a recognition device after a corresponding enquiry. These data can contain direct information about the desired destination floor or serve for the identification of the elevator user and thus make possible an access to the items of information, which are filed in a storage device, about the destination floor. The communication between the recognition device and the information transmitter takes place by means of, for example, radio frequencies. By reference to the received data, the destination floor is evaluated in a processing unit and fed to the multigroup control. The process of the destination call entry in this case takes place automatically and contactlessly. The passenger need now only move to the elevator serving his call, independently of the group.

Figure 5:
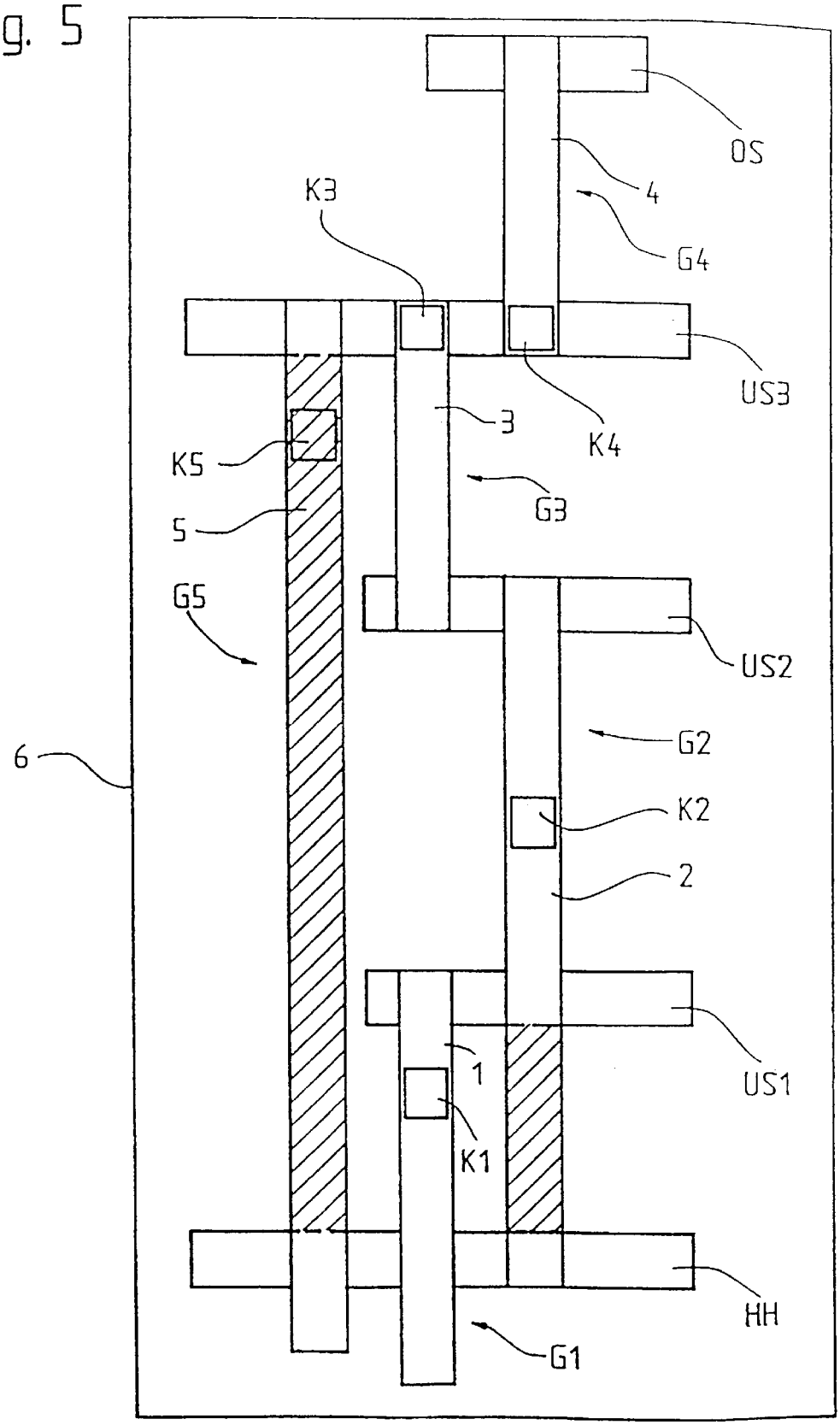
FIG. 5 shows a schematic illustration of several elevator groups in a tall building.

In FIG. 5, elevator shafts of elevator groups G1, G2, G3, G4 and G5 arranged in a tall building 6 are denoted 1, 2, 3, 4 and 5, wherein only one elevator shaft of the elevator group concerned is illustrated each time. In the elevator shafts, cars K1, K2, K3, K4 and KS are guided, which can serve specific floor regions allocated to the elevator groups. The cars K1 of the elevator group G1 serve a first floor region, which extends between a main stop HH, for example formed by the ground floor, and a first transfer floor US1, as well as the floors lying below the main stop HH. The cars K2 of the elevator group G2 serve the main stop HH and a second floor region extending between the first transfer floor US1, and second transfer floor US2, whereagainst the first floor region is not served (identified by hatching in FIG. 5). The third floor region, which is served by the cars K3 of the elevator group G3, extends between the second transfer floor US2 and a third transfer floor US3. A fourth floor region extends between the third transfer floor US3 and an uppermost floor OS and is served by the cars K4 of the elevator group G4. The cars K5 of the elevator group G5 serve merely the main stop HH as well as floors lying thereunder and the third transfer floor US3, whereagainst the floors lying therebetween are not served (identified by hatching in FIG. 5).

The elevator groups G1 to G5 are controlled by means of the multigroup controls. Equally, call-registering and display devices are arranged on the floors, by means of which devices calls can be entered for desired destination floors. Immediately after entry of the call, the identification (for example, in the form of a letter) of the most favorable elevator selected for the destination floor and an arrow indicating the position of the selected elevator relative to the call entry location are indicated in a display field of the call-registering and display device. The destination call controls of the elevator groups G1 to G5 are connected together and combined into the multigroup control so that, on the entry of a call for a desired destination floor, the elevator most favorable for this call is selected from the elevators of all elevator groups G1 to G5, which serve the same floor, and displayed.

Figure 6:
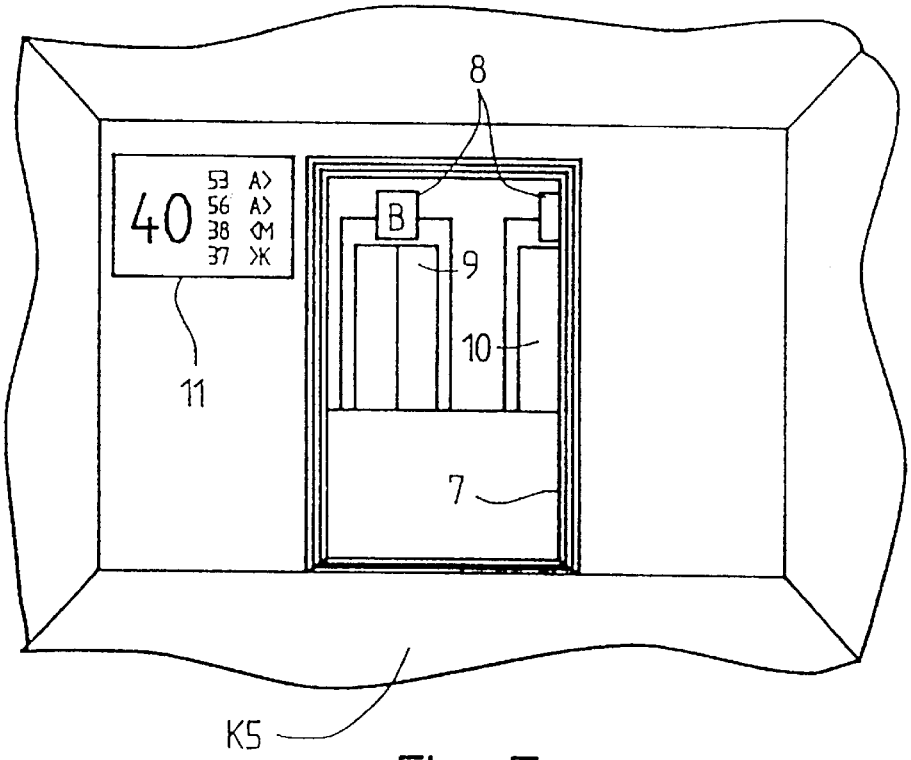
FIG. 6 shows, in perspective illustration, the interior of an elevator car with a display field of the display device.
Figure 7:
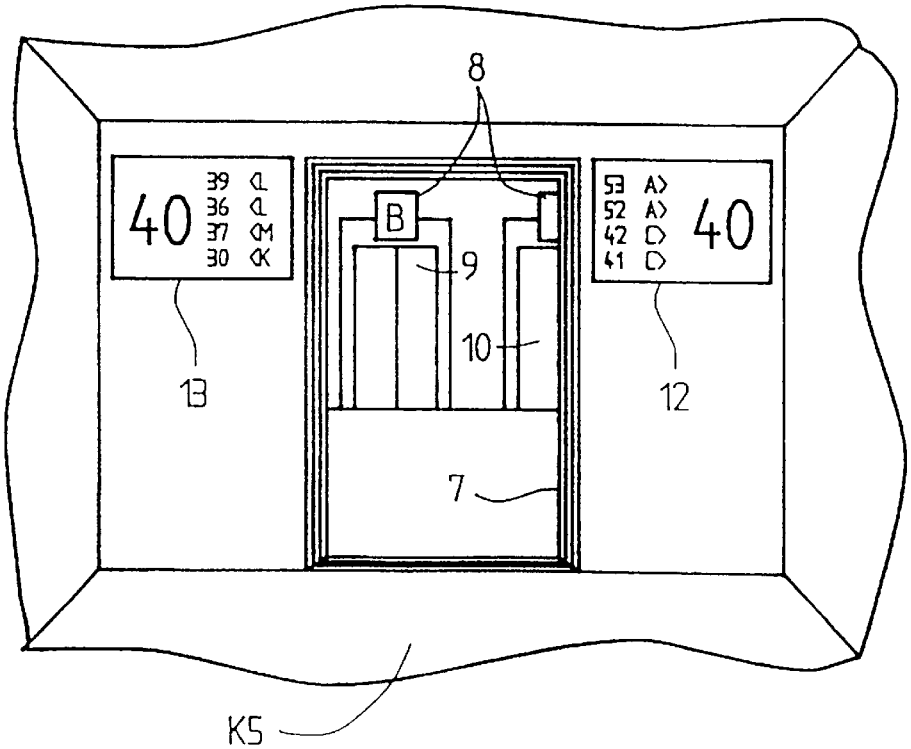
FIG. 7 shows, in perspective illustration, the interior of an elevator car with two display fields of the display device.

In FIGS. 6 and 7, cars of a elevator group are shown with the car door 7 open at a stop on a transfer floor. Shaft doors 9 and 10, which are identified by indicator plates 8 with the elevator letters, of another elevator group are to be seen through the opened car door 7. According to FIG. 6, a display field 11 of a display device (such as has become known in similar form, for example by EP-B 0 320 583) is arranged in the cars of the elevator groups, whereagainst two display fields 12 and 13, which are arranged to the right and to the left beside the car door 7, of the display device are provided according to FIG. 7. The display fields 11, 12 and 13 of an elevator group are each connected with the destination call controls of other elevator groups with common transfer floors. The number of the transfer floor, all destination calls in the form of the numbers of the destination floors, which cannot be served by the elevator concerned, and the elevators, which are associated with these destination calls and identified by letters provided with direction arrows, of other elevator groups are indicated in the display fields 11, 12 and 13. In this case, all associations of destination call and elevator are indicated in the display field 11 in the embodiment according to FIG. 6, whilst the destination calls allocated to the elevators lying to the right of the car door 7 are indicated in the righthand display field 12 and the destination calls allocated to the elevators lying to the left of the car door 7 are indicated in the lefthand display field 13 in the embodiment according to FIG. 7.

Let it be assumed, for example, that car K5 of the fifth elevator group G5 was allocated to the destination calls for the floors 37, 38, 53 and 56 (FIG. 6) entered at the main stop HH. Before reaching the transfer floor US3 (40, FIG. 6), for example at the instant of the onset of braking or already after the closing of the car door 7, the display field 11 is activated, wherein the destination calls, which cannot be served by the relevant car K5 of the elevator group G5 and have previously been passed over to the destination controls of the elevator groups G3 and G4 serving the same transfer floor US3, and the allocated selected elevators and their position are indicated. Passengers situated in the car K5 concerned thus know even before the transfer floor US3 that the elevator A of the elevator group G4 must be used for the floors 53 and 56 and the elevator K or the elevator group G3 must be used for the floors 37 and 38. The association of the selected elevators with the elevator groups G4 and G3 respectively is immaterial for the passengers, since the identification of the elevators is independent of the group association.

What is claimed is:

1. A control for several groups of a plurality of elevators, each elevator group serving a different sector of a building and having destination call controls and immediate allocation, the control comprising:

means for inputting a call for an elevator car;

display means for displaying an allocated car to a passenger in response to the input means; and a common multigroup control cooperating with the single destination call controls operatively connected to the input means and the display means for selecting a most favorable elevator from all elevators of all the groups, the destination call controls being combined in the common multigroup control.

2. A control according to claim 1, wherein the input means includes a destination call input device.

3. A control according to claim 1, wherein the input means includes an information transmitter and a recognition device operatively arranged to contactlessly and automatically input an elevator call.

4. A control according to claim 1, wherein the display means includes means for acoustically outputting information concerning the allocated car.

5. A control according to claim 1, wherein the common multigroup control includes a separate group control for each respective group of elevators, the group control being connected to controls of the individual elevators of the respective group, the common multigroup control further including a central multigroup control connected to the group controls.

6. A control according to claim 1, wherein the common multigroup control includes a separate group control for each respective group of elevators, the group control being connected to controls of the individual elevators of the respective group, one of the group controls being operative to function as a multigroup control.

7. A control according to claim 5, and further comprising communication cables arranged so as to interconnect the controls of the individual elevators, the control group and the central multigroup control.

8. A control according to claim 6, and further comprising communication cables arranged so as to interconnect the controls of the individual elevators with the control groups.

9. A control according to claim 5, and further comprising transmitter and receiver means for connecting together the controls.

10. A control according to claim 6, and further comprising transmitter and receiver means for connecting together the controls.

11. A control according to claim 1, and further comprising uniform designators for each of the elevators which are easily and unambiguously recognizable by a passenger.

12. A control according to claim 11, wherein the designators are Latin numerals arranged in one of ascending and descending sequence.

13. A control according to claim 1, wherein the display means includes a display field arranged in elevator cars of each of the elevators' groups, the display field being operative to display all destination calls which are not serviceable by a car in which the display field is arranged and passed over to at least one other elevator group, and also being operative to display associated selected elevators of the other elevator group and their position.

14. A control according to claim 13, wherein each elevator car has a door, the display means including two display fields provided in each elevator car and arranged right and left of the car door, the display fields being operative to display destination calls associated with elevators lying to the right of the car door the display field on the right side of the car door, and destination fields associated with the left side of the car door on the display shield on the left side of the car door.

15. A process for controlling several elevator groups each serving a different sector of a building and having destination call controls and immediate allocation, comprising the steps of:

inputting a call for an elevator car;

displaying an allocated car to a passenger in response to the input call; and selecting a most favorable elevator from all elevators of all elevator groups via a common multigroup control in which all destination call controls are combined.

* * * * *